US008974152B2

(12) United States Patent
Wang et al.

(10) Patent No.: US 8,974,152 B2
(45) Date of Patent: Mar. 10, 2015

(54) POLYMER GROUTING METHOD FOR CONSTRUCTING VERTICAL SUPPORTING SYSTEM

(71) Applicant: Henan Polytech Infrastructure Rehabilitation Ltd., Zhengzhou, Henan (CN)

(72) Inventors: Fuming Wang, Henan (CN); Mingsheng Shi, Henan (CN); Bei Zhang, Henan (CN); Chengchao Guo, Henan (CN); Yanhui Pan, Henan (CN)

(73) Assignee: SAFEKEY Engineering Technology(Zhengzhou), Ltd., Zhengzhou, Henan Province (CN)

( * ) Notice: Subject to any disclaimer, the term of this patent is extended or adjusted under 35 U.S.C. 154(b) by 0 days.

(21) Appl. No.: 13/866,026

(22) Filed: Apr. 19, 2013

(65) Prior Publication Data

US 2014/0314494 A1 Oct. 23, 2014

(30) Foreign Application Priority Data

Apr. 11, 2013 (CN) ..... 2013 1 0123667

(51) Int. Cl.
*E02D 3/12* (2006.01)
*E02D 17/04* (2006.01)
*E02D 17/13* (2006.01)

(52) U.S. Cl.
CPC ..... *E02D 17/04* (2013.01); *E02D 17/13* (2013.01)
USPC ..... 405/266; 405/229; 405/263

(58) Field of Classification Search
USPC ..... 405/263, 266–270, 229
See application file for complete search history.

(56) References Cited

U.S. PATENT DOCUMENTS

| | | | | | |
|---|---|---|---|---|---|
| 1,394,718 | A * | 10/1921 | Emery | ..... | 405/266 |
| 3,416,322 | A * | 12/1968 | Bodine | ..... | 405/267 |
| 6,299,386 | B1 * | 10/2001 | Byrne et al. | ..... | 405/273 |
| 6,799,924 | B1 * | 10/2004 | Kight et al. | ..... | 405/251 |
| 2011/0103898 | A1 * | 5/2011 | Wang et al. | ..... | 405/266 |

* cited by examiner

*Primary Examiner* — Sean Andrish

(57) ABSTRACT

A polymer grouting method for constructing a vertical supporting system, includes following steps of: (1) structuring an integrated polymer water-blocking panel; (2) constructing a polymer coping of a polymer vertical supporting system; (3) constructing polymer anchors on the integrated polymer water-blocking panel; (4) processing constructing connection of the polymer anchors; and (5) excavating vertically by layer in turn, wherein step (3) and step (4) is repeated until a construction of the polymer vertical supporting system reaches a projected depth, and then the construction of the polymer vertical supporting system is completed. The polymer vertical supporting system constructed according to the present invention has advantages, such as convenience, lightness, high tenacity, economy, and lasting long. The slots of foundation pits, side slopes, municipal pipelines, etc. can be excavated vertically fast by adopting the present invention.

3 Claims, 7 Drawing Sheets

POLYMER GROUTING METHOD FOR CONSTRUCTING VERTICAL SUPPORTING SYSTEM

BACKGROUND OF THE PRESENT INVENTION

1. Field of Invention

The present invention belongs to a side slope excavating supporting technology field of infrastructures of civil engineering, water conservancy, mining, municipality, etc., and particularly relates to a polymer grouting method for constructing vertical supporting system of excavating of foundation pit, side slope, municipal pipeline, etc.

2. Description of Related Arts

Since the founding of People's Republic of China, remarkable achievements have been made in infrastructure constructions of civil engineering, water conservancy, municipality, etc. In the process of using the underground space and exploiting the mineral resources, when facing the complex geological conditions, the measure of side slope supporting is usually required to be taken. Very often, affect of groundwater should also be considered. With the development of geotechnical engineering technology, machine, civil engineering materials, etc., the side slope supporting technology develops effectively. Supporting structure systems, such as soil nailing wall, composite soil nailing wall, underground continuous wall, row pile supporting and anchor pile supporting, correspondingly emerged. Meanwhile, in order to control the influence that the groundwater has on the side slope supporting and underground construction, the water-stopping curtain or the auxiliary water-lowering measure is also considered to be installed in the supporting system. Especially under the conditions of high underground water level and limited slope space, some groundwater treatment measures, such as water lowering and water stopping, are required to be taken in the foundation pit supporting. In contrast, taking the measure of water stopping can guarantee the safety of the surrounding buildings, structures and the underground pipeline better. Nowadays, the water stopping method in the side slope supporting system is embodied as technologies, such as cement mixing piles, high-pressure jet grouting pile, and TRD method. The above supporting technologies played important roles in practical projects, but they also have some technical shortages. For example, it is difficult to use the soil nailing wall under the condition of soft soil, unbonded loose sandy soil and rich underground water. In addition, when the soil nailing wall is used as a permanent structure, the problem of durability, such as corrosion, should be considered. The design of the composite soil nailing wall is mostly borrowed from the design of soil nailing wall, and the role of advance supporting and water-stopping curtain are not considered in the design and calculation of the composite soil nailing wall. For the underground continuous wall, sandy soil and mud dug out requires for the settlement equipment and the mechanical equipment, so the cost is high. In addition, the drainage tends to pollute the underground water, and excavating the slot tends to cause the settlement of the buildings. For the row pile supporting structure, there is no mature design method at present, and there are few systematic and in-depth researches on the stress mechanism, the working properties and the applicable conditions of the row pile. In addition, in the aspect of water-stopping material, the conventional side slope supporting technology mostly uses cement materials, so the water stopper constructed is a rigid solid having an elastic modulus greatly different from the elastic modulus of the soil, and is poor in impervious anti-cracking property. In the aspect of water-stopping mechanism, in the conventional technology, the materials and the soil are disassembled, when stopping the water, and the material grouted in is difficult to form a complete continuum. In the aspect of the construction, in the several conventional technologies, the water stopper is formed by the construction methods, such as excavating slots, mixing, spraying and vibrating, so the side slope structure is greatly damaged by turbulent motions. Thus, it is clear that these supporting technologies frequently used in projects mostly have shortages of great turbulence damages to the side slope, long construction period, high cost, inconvenient construction, etc. In addition, in some complicated stratum conditions, even if the different combination of the above various side slope supporting methods and water-stopping construction methods are applied, it is still difficult to meet the requirement of safety, practicality, economy, rationality, reliable quality, protecting environment, etc., so safety accidents caused by improper design and improper handling of construction occurs frequently. For the powder sands, the fine sand layer and the soil layer, which are relatively loose, if adopting the design idea of excavation and supporting at a same time, landslides tend to occur before the supporting structures are constructed in the excavation process. If the method of improved soil slope is adopted in advance, the construction period will be extended to 2~3 times, and the cost will increase by more than 1 time. The current situation is not suitable for the development requirement of the infrastructure building of civil engineering, water conservancy, mining, municipality, etc. of our country at present. Therefore, the research and development of the supporting system combining supporting structure and the water-blocking function is an important technological problem to be solved in the present in the side slope excavation process of civil engineering, water conservancy and municipality infrastructure constructions, such as foundation pit, side slope and municipal pipeline excavation.

Polymer grouting technology is a rapid foundation reinforcement technology developing in the 1970s. This technology takes advantage of characteristic that the polymer materials expand rapidly and solidify after the chemical reaction to reinforce the foundation, fill the void, and raise the floor by injecting the polymer materials into the foundation. At present, the polymer grouting technology is mainly applied in field of foundation reinforcement of industrial and civil building and road maintenance. The present invention provides a polymer grouting method for constructing a vertical supporting system combining water-blocking function and supporting reinforce function, and provides a new supporting technology to excavation of foundation pit, side slope and municipal pipeline. At present, there is no report related to the polymer grouting method for constructing vertical supporting system.

SUMMARY OF THE PRESENT INVENTION

An object of the present invention is to provide a polymer grouting method for constructing a vertical supporting system combining a water-blocking function and a supporting reinforce function to meet developing requirements of excavation supporting of foundation pit, side slope and municipal pipeline, and to make up for the shortage of the conventional supporting technology. The present invention is developed based on giving full play to the small permeability coefficient, good durability, and excellent expansion characteristics of the polymer materials, the earth pressure theory and the geotechnical anchoring theory. The slots of foundation pits, side slopes, municipal pipelines, etc. can be excavated vertically fast by adopting the present invention, which realizes advance water blocking and retaining for the side slopes in the process of excavation in the real sense, and greatly increases supporting speed of the side slopes. The present invention provides a new method to the excavation and supporting of the foundation pits, the side slopes, the municipal pipelines, etc., which is advanced, efficient, economic and practical.

Accordingly, in order to accomplish the above objects, the present invention provides a polymer grouting method for constructing a vertical supporting system, comprising following steps of:

(1) structuring an integrated polymer water-blocking panel, comprising following steps of:

1) locating the integrated polymer water-blocking panel and forming slots, comprising locating the integrated polymer water-blocking panel in an area of a side slope required to be excavated vertically according to a design, and forming slots continuously with a three-cone slot-forming plate and a direct pushing machine for slot-forming.

2) grouting into a slot hole, comprising putting a grouting pipe into the slot hole, wherein the grouting pipe extends to a bottom of the slot hole, injecting two-component expansive polymer grouting materials into the slot hole through the grouting pipe with a polymer grouting equipment, and lifting the grouting pipe with a lifting grouting control equipment at a same time, in such a manner that a polymer material fills the slot hole from bottom to top to form a polymer water-blocking panel, which is schistose; and 3) structuring the integrated polymer water-blocking panel by connecting the polymer water-blocking panels, comprising repeating the above step 2), wherein the polymer water-blocking panels in adjacent slot holes bond together tightly to form the integrated polymer water-blocking panel, which is continuous, even and regular;

(2) constructing a polymer coping of a polymer vertical supporting system, comprising following steps of:

1) construction of mesh reinforcements, wherein vertical mesh reinforcements are constructed by a hammer method and the horizontal mesh reinforcements are constructed by a binding method;

2) excavating vertically downwards in a side where a supporting system is constructed, to obtain a shallow slot having a depth of 280~320 mm, and to interlock surface structure reinforcements and the mesh reinforcements in a coping; and 3) locating and installing a coping shaping steel die above the shallow slot, and processing a polymer grouting through a grouting hole preset on a top of the coping shaping steel die, to form the polymer coping of the supporting system;

(3) constructing polymer anchors on the integrated polymer water-blocking panel, comprising following steps of:

1) excavating vertically by layer at a vertical spacing of 1.2-2 m, wherein a protecting soil having a thickness of 150-200 mm is reserved at a position of the integrated polymer water-blocking panel for being cleared by a manual method; and 2) processing polymer anchoring construction on the integrated polymer water-blocking panel cleared, comprising steps of:

a) producing anchor rods, comprising aligning rods and removing rust from the rods, cutting welding materials, welding centring supports, and binding a hole-sealing capsule and a hole-sealing grouting pipe on an end portion of each rod, wherein the hole-sealing capsule is at a join of an anchor section and a free section when being bound, a detachable inlet valve is provided at a polymer inlet of an anchoring grouting pipe, a connecting join between the grouting pipes and a grouting gun is fixed and sealed by a hose clamp, the grouting pipes comprise two grouting pipes, a first grouting pipe is the hole-sealing grouting pipe, an outlet of which is provided in the hole-sealing capsule, and a second grouting pipe is the anchoring grouting pipe, an outlet of which is provided in a bottom of an anchoring hole;

b) anchoring holes construction, comprising constructing anchoring holes at a spacing of 1.2-2 m;

c) implanting the anchor rods, comprising implanting the anchor rods made before into the anchoring holes, and ensuring that each of the rods are in a central position; and d) polymer grouting, comprising processing hole-sealing grouting firstly, i.e. injecting the two-component expansive polymer grouting material into the hole-sealing capsule with a grouting equipment, and then processing anchoring grouting, i.e. injecting the two-component expansive polymer grouting materials into the anchoring grouting pipe with the grouting equipment, wherein the polymer material fill the anchoring holes from the bottom of the anchoring holes progressively, and the two-component expansive polymer grouting material expands and pressurizes soil of a hole wall tightly to have a close contact with the surrounding soil, in such a manner that polymer anchors are formed;

(4) processing constructing connection of the polymer anchors, wherein all adjacent polymer anchors are connected by the surface structure reinforcements, polymer heel blocks and steel backing plates; and (5) excavating vertically by layer in turn, wherein step 3 and step 4 is repeated until a construction of the polymer vertical supporting system reaches a projected depth, and then the construction of the polymer vertical supporting system is completed.

Compared to the conventional supporting technologies, the present invention has following advantages of:

(1) integrating blocking water function and supporting function, i.e. the slots of foundation pits, side slopes, municipal pipelines, etc. can be excavated vertically fast by adopting the present invention, which realizes advance water blocking and retaining for the side slopes in the process of excavation in a same time, and greatly increases constructing speed of the side slopes supporting;

(2) a great withdrawal resistance and a high strength of the polymer anchors in the polymer supporting system, i.e. polymer materials have excellent expansion characteristics in a reaction process, and have a great extrusion load on the soil of a side wall of the anchors, at a same time, the polymer materials bond fully with the surrounding soil, to form a root-shaped bonding structure having a strong cohesive force, in such a manner that the withdrawal resistance of the polymer anchor rod is obviously better that a withdrawal resistance of a cement paste anchor rod;

(3) construction without water, i.e. adopting construction method without water, wherein non-water reacted type polymer materials don't shrink in air, have good tractility, anti-vibrating property and anti-cracking property;

(4) fast and convenient construction and not requiring for leaving to firm, i.e. the polymer blocking water panel, the coping and anchor grouting can be constructed continuously without intervals, so the construction is fast and convenient, about 90% of the strength can be formed 15 minutes after the materials react, so leaving to firm is not required, compared to conventional supporting structure system, more than 80% of the construction period can be saved;

(5) competitive composite economic results, i.e. compared to the conventional supporting technologies, the polymer vertical supporting system is mainly characteristic in realizing blocking water function while keeping the side slope stable, and saving a large quantity of construction period.

(6) convenient construction, i.e. polymer grouting system equipments are suitable for various kinds of area, such as large-sized area, medium-sized area, and small sized area; and (7) good durability, i.e. the polymer grouting material has a stable performance, no pollution, a good flexibility, the polymer supporting system constructed bonds with the soil tightly, has a compatible deformation with the soil, a low permeability coefficient, and a preservative effect on the reinforcement as a water-resisting layer.

Therefore, the polymer grouting method for constructing the vertical supporting system according to the present invention has obvious advantages in construction process of excavation project of foundation pit, side slope, municipal pipeline, etc. Compared to conventional supporting technologies, the polymer grouting method for constructing the vertical supporting system is a wholly new technology, which is embodied in following aspects.

(1) In an aspect of the supporting materials and supporting ideas, the water-blocking panel and the anchors in the polymer vertical supporting system is embodied as a new non-water reacted typed high-molecular polymer grouting material according to an idea of flexible supporting, which has characteristics, such as safety, environmental protection, lightness, durableness, high expansion rate, good permeability resistance and early strength. The polymer water-blocking panel constructed is a flexible anti-seepage element, which bonds with the soil tightly, has a compatible deformation with the soil, has good anti-cracking and anti-seepage properties, and realizes advance supporting.

(2) In an aspect of force mechanism, the polymer vertical supporting system makes full use of the high expansion characteristic of the polymer materials. The polymer anchors after expanding bond tightly with the surrounding soil, and are able to provide a larger withdrawal resistance, to help keeping the polymer water-blocking panel stable and to save slope-setting unload space. All of the anchor rods work, because of being constructing connected together. The anchor rods are stressed synergistically, and the withdrawal resistances generated by all of the anchor rods are able to balance out a lateral soil pressure, in order to ensure a stability of the supporting system.

(3) In an aspect of construction method, the polymer grouting method for constructing the vertical supporting system makes use of self-expansibility and rheological property of the polymer material to form the ultrathin polymer water-blocking panel, and to construct the coping and the anchors, which fully shows a technical advantage of fast and convenient construction.

In conclusion, the present invention is obviously different from the conventional supporting technologies in aspects of the supporting materials, the supporting ideas, the force mechanism, the construction method, etc. The present invention has the advantages of fastness and convenience, lightness, high tenacity, economy, durableness, etc., and is successfully applied in foundation pit supporting engineering, so the present invention has a good prospect in development and application.

These and other objectives, features, and advantages of the present invention will become apparent from the following detailed description, the accompanying drawings, and the appended claims.

DETAILED DESCRIPTION OF THE PREFERRED EMBODIMENT

According to a design of a polymer vertical supporting system based on data, such as geological survey reports, foundation drawings and experiences in areas, a polymer grouting method for constructing a vertical supporting system comprises following steps of:

(1) structuring an integrated polymer water-blocking panel 3, comprising following steps of:

1) locating the integrated polymer water-blocking panel 3 and forming slots, comprising locating the integrated polymer water-blocking panel 3 in an area of a side slope required to be excavated vertically according to a design, and forming slots continuously on a ground 1 with a three-cone slotting board and a static slotting machine.

Figure 1:
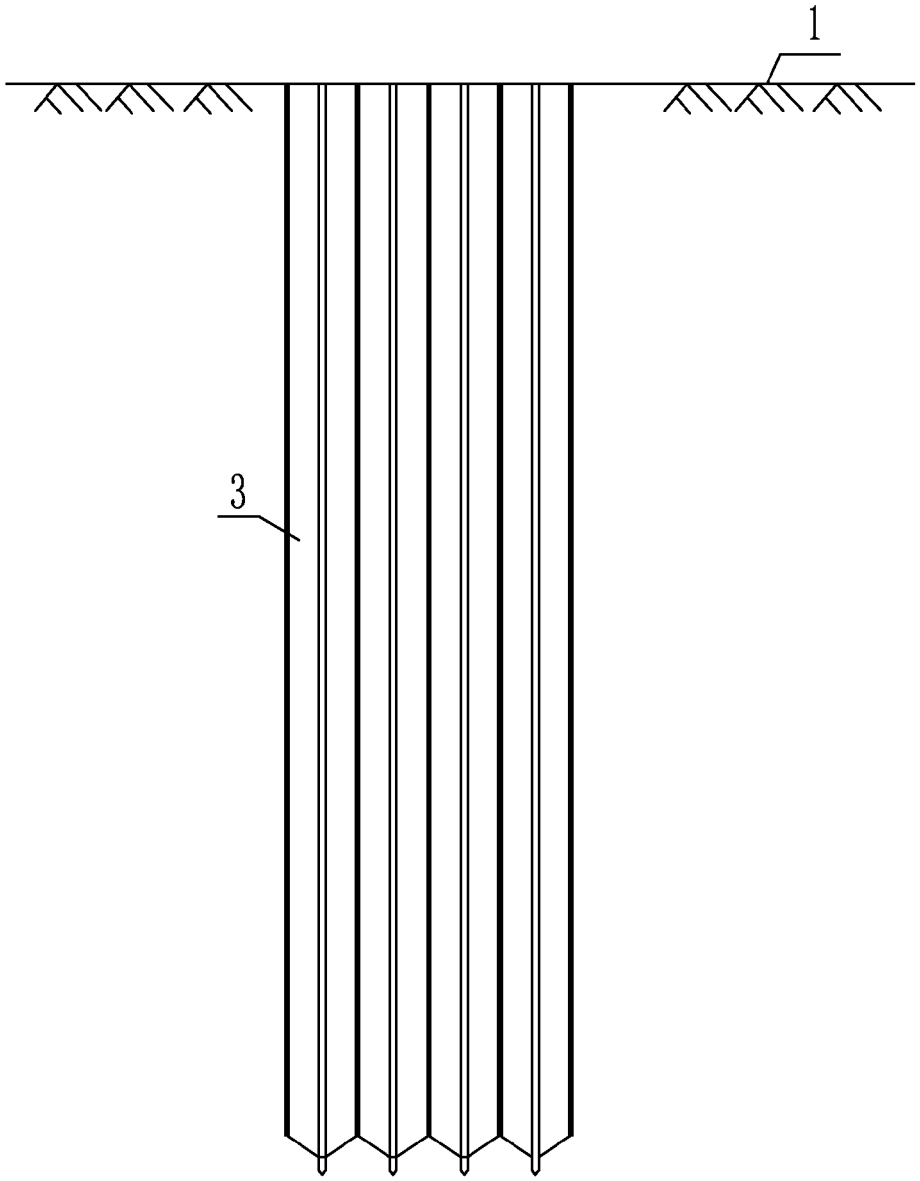
FIG. 1 is a sketch view of a polymer water-blocking panel according to a preferred embodiment of the present invention.
Figure 2:
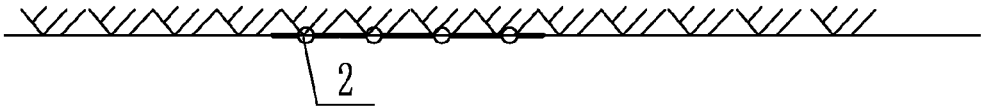
FIG. 2 is a top view of FIG. 1.
Figure 3:
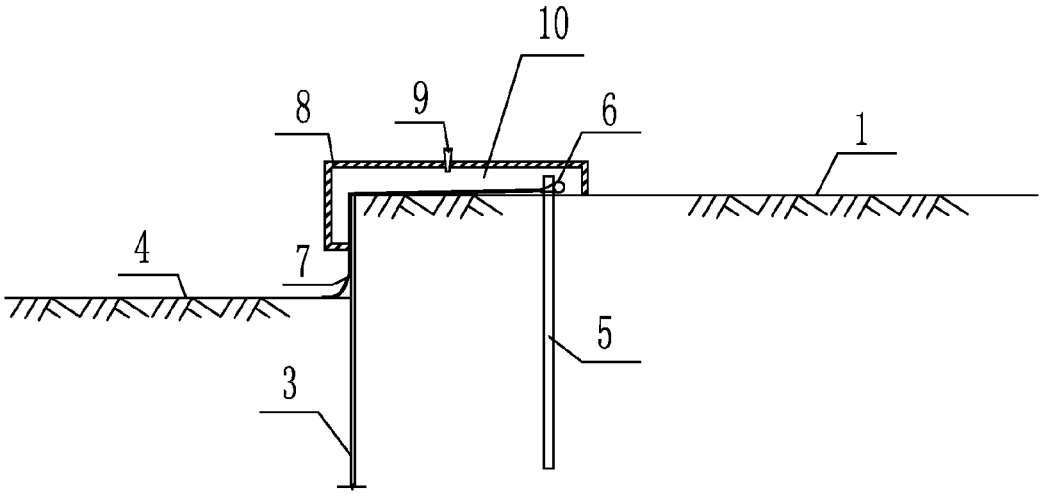
FIG. 3 is a sketch view of a coping of a polymer vertical supporting system according to the preferred embodiment of the present invention.
Figure 4:
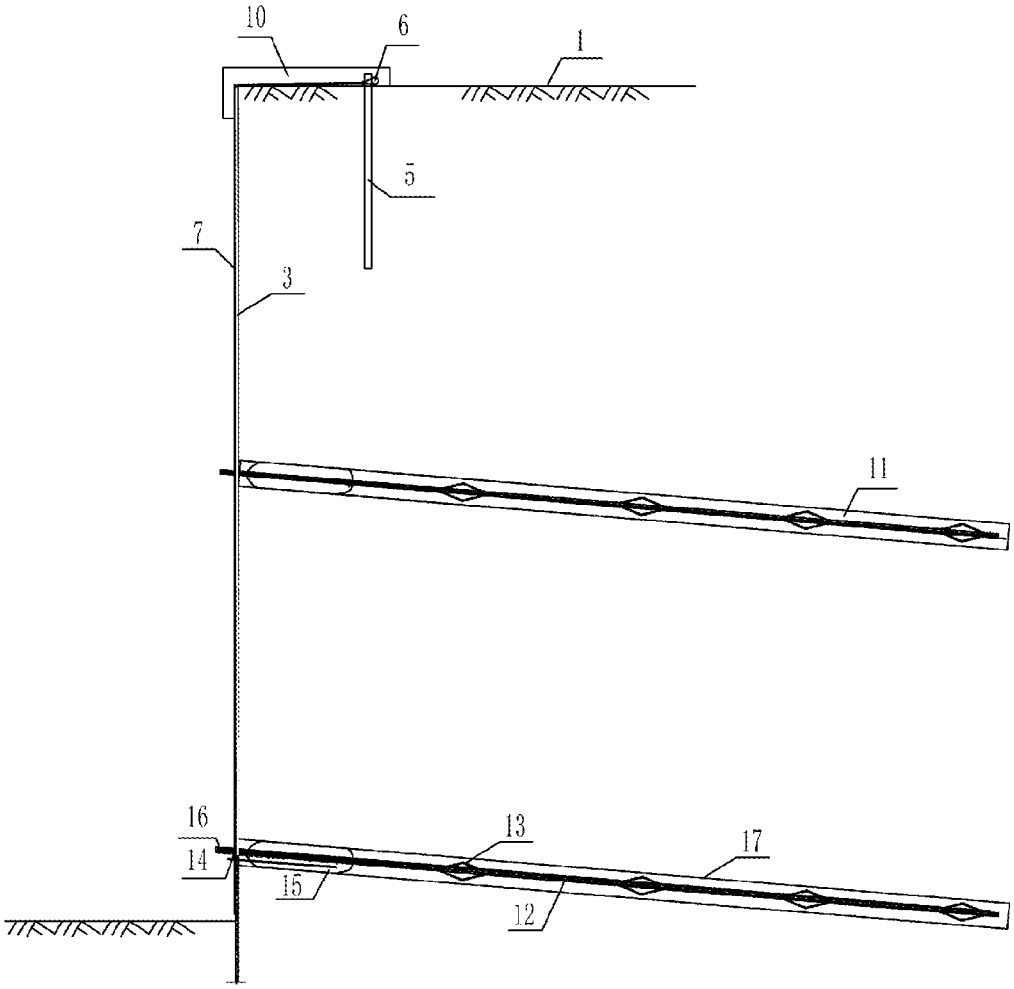
FIG. 4 is a sketch view of polymer anchors according to the preferred embodiment of the present invention.
Figure 5:
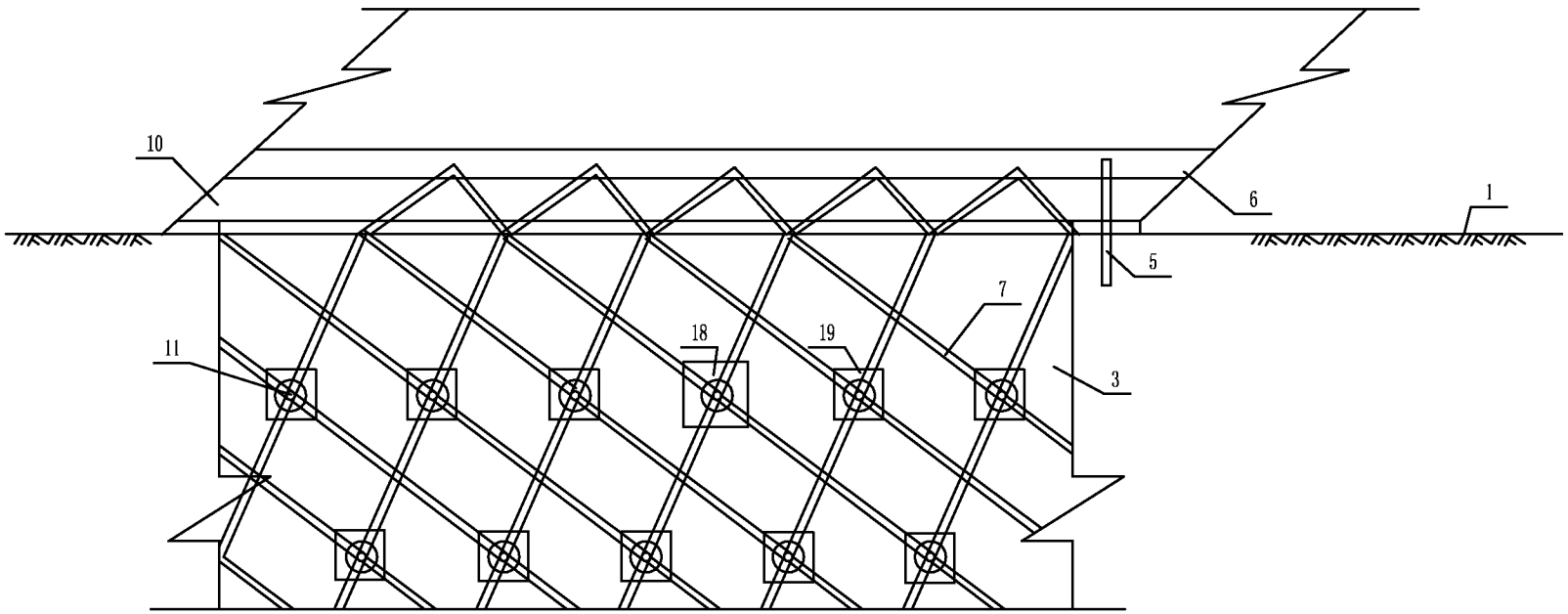
FIG. 5 is a connecting sketch view of polymer anchor rods according to the preferred embodiment of the present invention.
Figure 6:
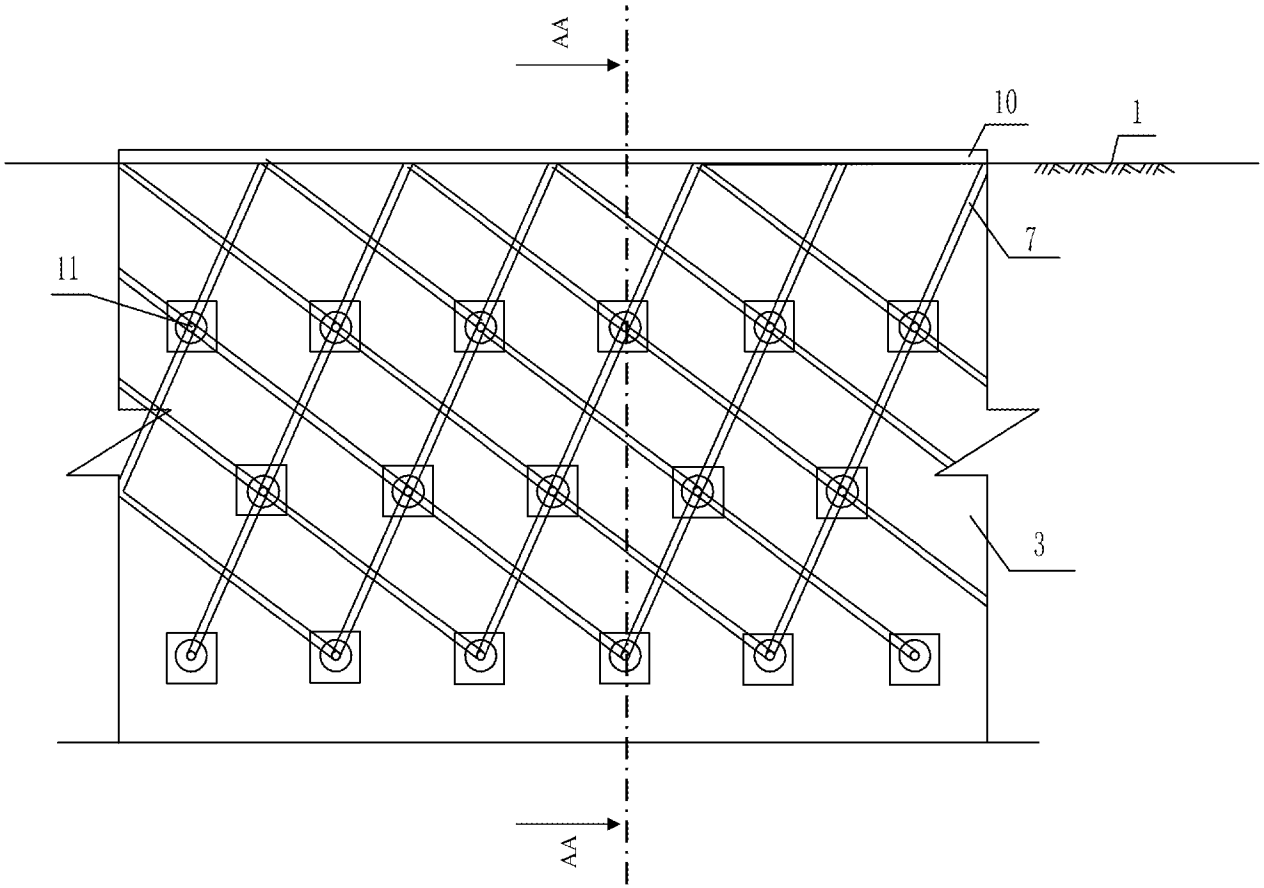
FIG. 6 is a front sketch view of a whole impression of the polymer vertical supporting system according to the preferred embodiment of the present invention.
Figure 7:
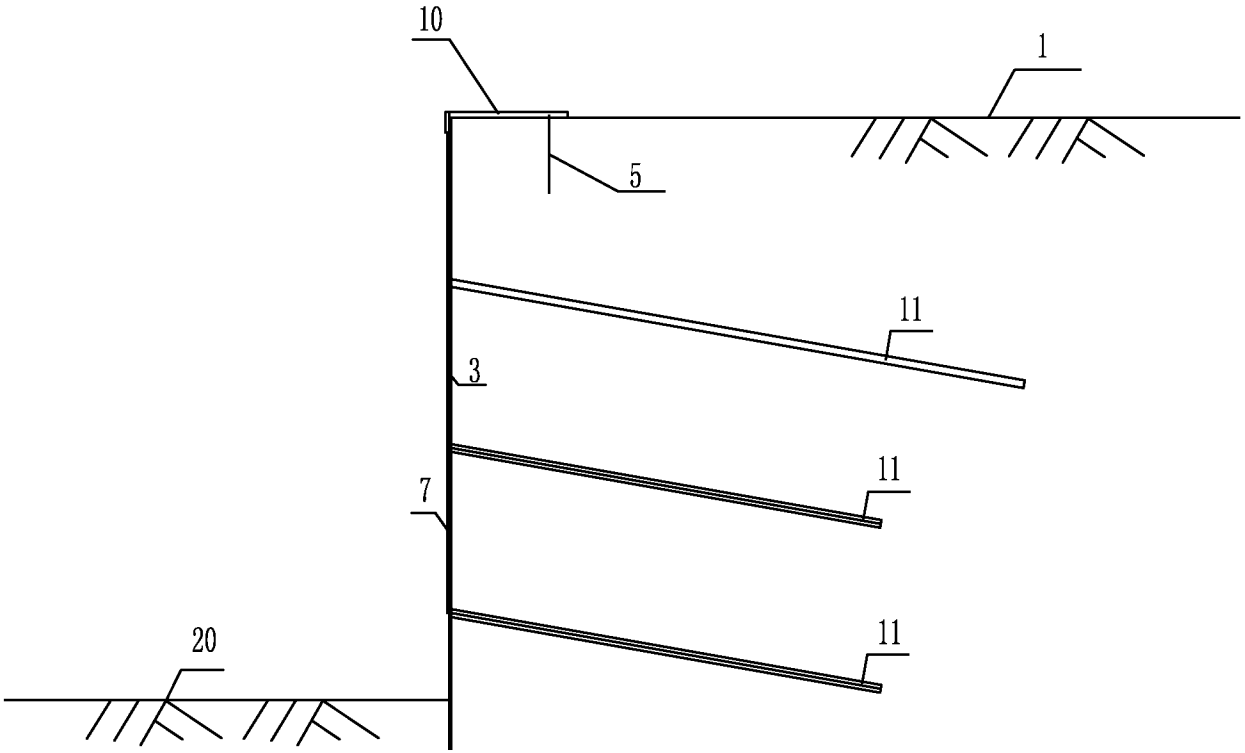
FIG. 7 is a sectional view of the whole impression of the polymer vertical supporting system according to the preferred embodiment of the present invention.

2) grouting into a slot hole 2, comprising putting a grouting pipe into the slot hole 2, wherein the grouting pipe extends to a bottom of the slot hole 2, injecting two-component expansive polymer grouting materials into the slot hole 2 through the grouting pipe with a polymer grouting equipment, and lifting the grouting pipe with a lifting grouting control equipment at a same time, in such a manner that a polymer material fills the slot hole 2 from bottom to top to form a polymer water-blocking panel; and 3) structuring the integrated polymer water-blocking panel 3 by connecting the polymer water-blocking panels, comprising repeating the above step 2), wherein the polymer water-blocking panels in adjacent slot holes bond together tightly to form the integrated polymer water-blocking panel 3, which is continuous, even and regular, as referred to FIG. 1 and FIG. 2;

(2) constructing a polymer coping of a polymer vertical supporting system, comprising following steps of:

1) construction of mesh reinforcements, wherein vertical mesh reinforcements 5 are constructed by a hammer method and the horizontal mesh reinforcements 6 are constructed by a binding method;

2) excavating vertically downwards in a side where a supporting system is constructed, to obtain a shallow slot having a depth of 280~320 mm, to form a ground with the shallow slot 4, and interlocking surface structure reinforcements 7 and the mesh reinforcements in a coping; and 3) locating and installing a coping shaping steel die 8 above the shallow slot, and processing a polymer grouting through a grouting hole 9 preset on a top of the coping shaping steel die 8, to form the polymer coping 10 of the supporting system, as referred to FIG. 3;

(3) constructing polymer anchors on the integrated polymer water-blocking panel 3, comprising following steps of:

1) excavating vertically by layer at a vertical spacing of 1.2-2 m, wherein a protecting soil having a thickness of 150-200 mm is reserved at a position of the integrated polymer water-blocking panel 3 for being cleared by a manual method; and 2) processing polymer anchoring construction on the integrated polymer water-blocking panel 3 cleared, comprising steps of:

a) producing anchor rods, wherein rods 12 can be made of reinforcing bars or steel strand according to designing requirements, comprising aligning the rods 12 and removing rust from the rods, cutting welding materials, welding centring supports 13, and binding a hole-sealing capsule 15 and a hole-sealing grouting pipe 14 on an end portion of each rod 15, wherein the hole-sealing capsule 15 is at a join of an anchor section and a free section when being bound, a detachable inlet valve is provided at a polymer inlet of an anchoring grouting pipe 16, a connecting join between the grouting pipes and a grouting gun is fixed and sealed by a hose clamp, the grouting pipes comprise two grouting pipes, a first grouting pipe is the hole-sealing grouting pipe 14, an outlet of which is provided in the hole-sealing capsule 15, and a second grouting pipe is the anchoring grouting pipe 16, an outlet of which is provided in a bottom of an anchoring hole 17;

b) anchoring holes 17 construction, comprising constructing anchoring holes 17 at a spacing of 1.2-2 m;

c) implanting the anchor rods, comprising implanting the anchor rods made before into the anchoring holes 17 and ensuring that each of the rods 12 is in a central position; and d) polymer grouting, comprising processing hole-sealing grouting firstly, i.e. injecting the two-component expansive polymer grouting material into the hole-sealing capsule 15 with a grouting equipment, and then processing anchoring grouting, i.e. injecting the two-component expansive polymer grouting material into the anchoring grouting pipe 16 with the grouting equipment, wherein the polymer materials fill the anchoring holes 17 from the bottom of the anchoring holes 17 progressively, and the two-component expansive polymer grouting material expands and pressurizes soil of a hole wall tightly to have a close contact with the surrounding soil, in such a manner that polymer anchors 11 are formed, as referred to FIG. 4;

(4) processing constructing connection of the polymer anchors, wherein all adjacent polymer anchors are connected by the surface structure reinforcements 7, polymer heel blocks 18 and steel backing plates 19, as referred to FIG. 5; and (5) excavating vertically by layer in turn, wherein step 3 and step 4 is repeated until a construction of the polymer vertical supporting system reaches a projected depth 20, and then the construction of the polymer vertical supporting system is completed, as referred to FIG. 6 and FIG. 7.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A polymer grouting method for constructing a vertical supporting system, comprising following steps of:

(1) structuring an integrated polymer water-blocking panel;

(2) constructing a polymer coping of the polymer vertical supporting system;

(3) constructing polymer anchors on the integrated polymer water-blocking panel;

(4) constructing a connection between the polymer anchors, wherein all adjacent polymer anchors are connected by surface structure reinforcements, polymer heel blocks and steel backing plates; and (5) excavating layers of soil sequentially, wherein step (3) and step (4) are repeated until a construction of the polymer vertical supporting system reaches a projected depth, and then the construction of the polymer vertical supporting system is completed;

wherein the step (1) comprises following steps of:

1) locating the integrated polymer water-blocking panel and forming slots, comprising locating the integrated polymer water-blocking panel in an area of a side slope required to be excavated vertically according to a design, and forming the slots continuously with a three-cone slotting board and a static slotting machine;

2) grouting into a slot hole, comprising putting a grouting pipe into the slot hole, wherein the grouting pipe extends to a bottom of the slot hole, injecting two-component expansive polymer grouting materials into the slot hole through the grouting pipe with a polymer grouting equipment, and lifting the grouting pipe with a grouting pipe lift at a same time, in such a manner that a polymer material fills the slot hole from bottom to top to form a polymer water-blocking panel, which is schistose; and 3) structuring the integrated polymer water-blocking panel by connecting polymer water-blocking panels, comprising repeating the above step (2), wherein the polymer water-blocking panels in adjacent slot holes bond together tightly to form the integrated polymer water-blocking panel, which is continuous, even and regular.

2. A polymer grouting method for constructing a vertical supporting system, comprising following steps of:

(1) structuring an integrated polymer water-blocking panel;

(2) constructing a polymer coping of the polymer vertical supporting system;

(3) constructing polymer anchors on the integrated polymer water-blocking panel;

(4) constructing a connection between the polymer anchors, wherein all adjacent polymer anchors are connected by surface structure reinforcements, polymer heel blocks and steel backing plates; and (5) excavating layers of soil sequentially, wherein step (3) and step (4) are repeated until a construction of the polymer vertical supporting system reaches a projected depth, and then the construction of the polymer vertical supporting system is completed;

wherein the step (2) comprises following steps of:

(a) construction of mesh reinforcements, wherein vertical mesh reinforcements are constructed by a hammer method and horizontal mesh reinforcements are constructed by a binding method;

(b) excavating vertically downwards in a side where a supporting system is constructed, to obtain a shallow slot having a depth of 280~320 mm, and to interlock the surface structure reinforcements and all of the mesh reinforcements in the coping; and (c) locating and installing a coping shaping steel die above the shallow slot, and processing a polymer grouting through a grouting hole preset on a top of the coping shaping steel die, to form the polymer coping of the supporting system.

3. A polymer grouting method for constructing a vertical supporting system, comprising following steps of:

(1) structuring an integrated polymer water-blocking panel;

(2) constructing a polymer coping of the polymer vertical supporting system;

(3) constructing polymer anchors on the integrated polymer water-blocking panel;

(4) constructing a connection between the polymer anchors, wherein all adjacent polymer anchors are connected by surface structure reinforcements, polymer heel blocks and steel backing plates; and (5) excavating layers of soil sequentially, wherein step (3) and step (4) are repeated until a construction of the polymer vertical supporting system reaches a projected depth, and then the construction of the polymer vertical supporting system is completed;

wherein the step (3) comprises following steps of:

1) excavating layers of soil sequentially at a vertical spacing of 1.2-2 m, wherein a protecting soil having a thickness of 150-200 mm is reserved at a position of the completed integrated polymer water-blocking panel by a manual method; and 2) processing polymer anchoring construction on the integrated polymer water-blocking panel cleared;

wherein the step 2) comprises following steps of:

a) producing anchor rods, comprising aligning rods and removing rust from the rods, cutting welding materials, welding centering supports, and binding a hole-sealing capsule and a hole-sealing grouting pipe on an end portion of each rod, wherein the hole-sealing capsule is at a join of an anchor section and a free section when being bound, a detachable inlet valve is provided at a polymer inlet of an anchoring grouting pipe, a connecting join between the grouting pipes and a grouting gun is fixed and sealed by a hose clamp, the grouting pipes comprise two grouting pipes, a first grouting pipe is the hole-sealing grouting pipe, an outlet of which is provided in the hole-sealing capsule, and a second grouting pipe is the anchoring grouting pipe, an outlet of which is provided in a bottom of an anchoring hole;

b) anchoring holes construction, comprising constructing anchoring holes at a spacing of 1.2-2 m;

c) implanting the anchor rods, comprising implanting the produced anchor rods into the anchoring holes, and ensuring that each of the rods is in a central position; and d) polymer grouting, comprising processing hole-sealing grouting firstly, comprising injecting a two-component expansive polymer grouting material into the hole-sealing capsule with a grouting equipment;

and then processing anchoring grouting, comprising injecting the two-component expansive polymer grouting materials into the anchoring grouting pipe with the grouting equipment, wherein the polymer materials fill the anchoring holes from the bottom of the anchoring holes progressively, and the two-component expansive polymer grouting material expands and pressurizes soil of a hole wall tightly to have a close contact with the surrounding soil, in such a manner that the polymer anchors are formed.

* * * * *